United States Patent [19]

Schilling

[11] Patent Number: 4,735,551

[45] Date of Patent: Apr. 5, 1988

[54] RADIAL BLOWER

[75] Inventor: Jürgen Schilling, Wermelskirchen, Fed. Rep. of Germany

[73] Assignee: Vaillant GmbH u. Co., Remscheid, Fed. Rep. of Germany

[21] Appl. No.: 672,788

[22] Filed: Nov. 19, 1984

[63] Continuation-in-part of PCT DE84/00048, Mar. 9, 1984, published as WO84/03740, Sep. 27, 1984.

[30] Foreign Application Priority Data

Mar. 19, 1983 [DE] Fed. Rep. of Germany ... 8308535[U]

[51] Int. Cl.[4] ..... F01D 1/08

[52] U.S. Cl. ..... 415/206; 415/219 C

[58] Field of Search ..... 415/206, 207, 219 A, 415/219 R, 219 B, 219 C, 204, 205, 53 R

[56] References Cited

U.S. PATENT DOCUMENTS

| | | | |
|---|---|---|---|
| 1,914,919 | 6/1933 | Heermans | 415/219 B |
| 2,322,357 | 6/1943 | Hagen | 415/207 |
| 2,387,348 | 10/1945 | Place | 415/219 B |
| 2,420,401 | 5/1947 | Prokofieff | 415/207 |
| 2,841,326 | 7/1958 | Davis | 415/204 |
| 2,994,348 | 8/1961 | Cape | 415/219 C |
| 3,029,744 | 4/1962 | Goettl | 415/206 |
| 3,166,394 | 1/1965 | Lockwood | 415/219 B |
| 3,380,711 | 4/1968 | Blattner et al. | 415/206 |
| 3,707,335 | 12/1972 | Barnard | 415/219 C |
| 3,824,028 | 7/1974 | Zenkner et al. | 415/53 R |
| 4,252,502 | 2/1981 | Scheidel | 415/219 C |
| 4,255,080 | 3/1981 | Wilson et al. | 415/53 R |
| 4,389,159 | 6/1983 | Sarvanne | 415/219 C |
| 4,512,716 | 4/1985 | Marr et al. | 415/219 B |

FOREIGN PATENT DOCUMENTS

| | | | |
|---|---|---|---|
| 131799 | 7/1984 | Japan | 415/207 |

*Primary Examiner*—Robert E. Garrett
*Assistant Examiner*—John T. Kwon
*Attorney, Agent, or Firm*—Horst M. Kapser

[57] ABSTRACT

A radial blower is provided with a spiral shape casing, which has an input port for the medium to be moved and an output port for the medium to be delivered. The input port is disposed on the side of the casing in the direction of a spiral axis and where the center of the input port is displaced relative to the center of the spiral. The output port connects the start of the spiral section to the end of the spiral section and forms a connection piece. The output port according to the invention increases in its cross-section continuously while going from the connection point of the spiral to the outer end. Preferably a protruding nose is placed at the junction point of the output port and of the smaller radius side of the spiral for enhancing the pushing power of the fan blades versus the medium and for reducing the flow resistance of the output port to the medium stream. This reduces the power requirements of the motor and increases the slope of the characteristic line for the dependence of the pressure on amount of medium flowing through.

19 Claims, 5 Drawing Sheets

RADIAL BLOWER

CROSS-REFERENCE TO RELATED APPLICATIONS

This application is a continuation-in-part application of another international application filed under the Patent Cooperation Treaty on Mar. 9, 1984 and bearing application No. PCT/DE84/00048. The entire disclosure of this application, including the drawings thereof, is hereby incorporated in this application as if fully set forth herein.

BACKGROUND OF THE INVENTION

1. Field of the Invention

The present invention relates to a radial blower or centrifugal fan with a casing forming a spiral, which casing has an input port and an output port, where the input port is on the side of the casing in the direction of a spiral axis and where the center axis of the input port is displaced with respect to the center of the spiral axis.

2. Brief Description of the Background of the Invention Including Prior Art

Radial flow compressors, centrifugal fans or radial blowers are known in a plurality of versions. In general, they are associated with the disadvantage that they have a relatively flat characteristic curve. In the context of the present invention, the dependence of the pressure of the transported medium on the blow-through is defined as the characteristic curve.

SUMMARY OF THE INVENTION

1. Object of the Invention

It is an object of the present invention to provide a radial blower which has a steeper characteristic line for the dependence of the pressure of the transported medium on its passage flow.

It is another object of the present invention to provide a centrifugal fan where the amount of medium passing through versus the corresponding flow through change is relatively small.

These and other objects and advantages of the present invention will become evident from the description which follows.

2. Brief Description of the Invention

The present invention provides a radial blower with a casing forming a spiral having a spiral axis. A section of the spiral formed by the casing can be approximated by a archimedian spiral which is defined by the radius being a multiple of the angle passed over relative to the center of the spiral. The casing is attached to an input port having a center in the opening plane and an output port with a diameter which increases toward an outside flow discharge end. The input port is disposed in an axial direction of the spiral axis, and the entrance of the input port is displaced with respect to the spiral axis. The output port joins the outer side of an inner spiral end with the inside of an outer spiral end.

The connection point of the inner spiral to the output port can correspond to an angle of from about 200 to 800 degrees of the approximated archimedian spiral and the connection point of the outer spiral to the output port can correspond to an angle of from about 500 to 1150 degrees. The connection point of the inner spiral to the output port can correspond to an angle of from about 300 to 500 degrees and the connection point of the outer spiral to the output port can correspond to an angle of from about 600 to 850 degrees. The increase of the diameter of the output port may be disposed in the plane of the spiral. The output port can be formed like a wedge where the wedge opening angle of the output port may be between from about 5 to 20 degrees and is preferably from about 8 to 12 degrees.

The connection point of the smaller diameter side of the spiral and of the corresponding wall of the output port can join into a protruding nose for relatively enhancing the pushing power of the rotary fan and for relatively decreasing the flow resistance of the output port to the medium being discharged. This protruding nose can be connected to an outwardly diverging wall of the discharge port via a curved surface which can be directed concavely to the inner space of the output port. The curvature of the curved surface may have a radius of from about 5 to 20 millimeters and preferably of from about 8 to 12 millimeters, and the center angle of the curvature may be from about 10 to 50 degrees and preferably from about 25 to 35 degrees. The ratio of the curvature of the curved surface and of the curvature of the nose may be from about 2:1 to 10:1.

The casing of the radial blower may be attached to an oil burner, and the output port can be connected to the air input of the burner.

The present invention also provides a method for blowing fluid medium with a spiral blower incorporating a rotary fan and comprising sucking in the medium through an input port disposed on one of the sides of the casing in the direction of the axis of the spiral and having its center displaced relative to the axis of the rotary fan, which rotary fan is disposed with its axis at about the axis of the spiral casing of the blower; pushing the medium with the fan disposed in the casing through the spiral casing and removing the pushed medium via an output port which adjoins the spiral, where the output port increases continuously in its diameter starting at the connection point to the spiral. The connection point of the smaller diameter side of the spiral and of the corresponding wall of the output port can join into a protruding nose for relatively enhancing the pushing power of the rotary fan and for relatively decreasing the flow resistance of the output port to the medium being discharged.

The medium employed may be air which is fed to an oil burner. The oxygen contained in the air may be chemically reduced with a fluid composition containing a member of the group consisting of hydrogen and carbon, which member in turn is oxidized to the respective oxide.

The technical advantage resulting from this invention is that simulataneously with the increase in the slope of the characteristic line, the width of the variation of the pressure relative to a certain volume amount of passing medium decreases.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF THE INVENTION AND PREFERRED EMBODIMENTS

Figure 1:
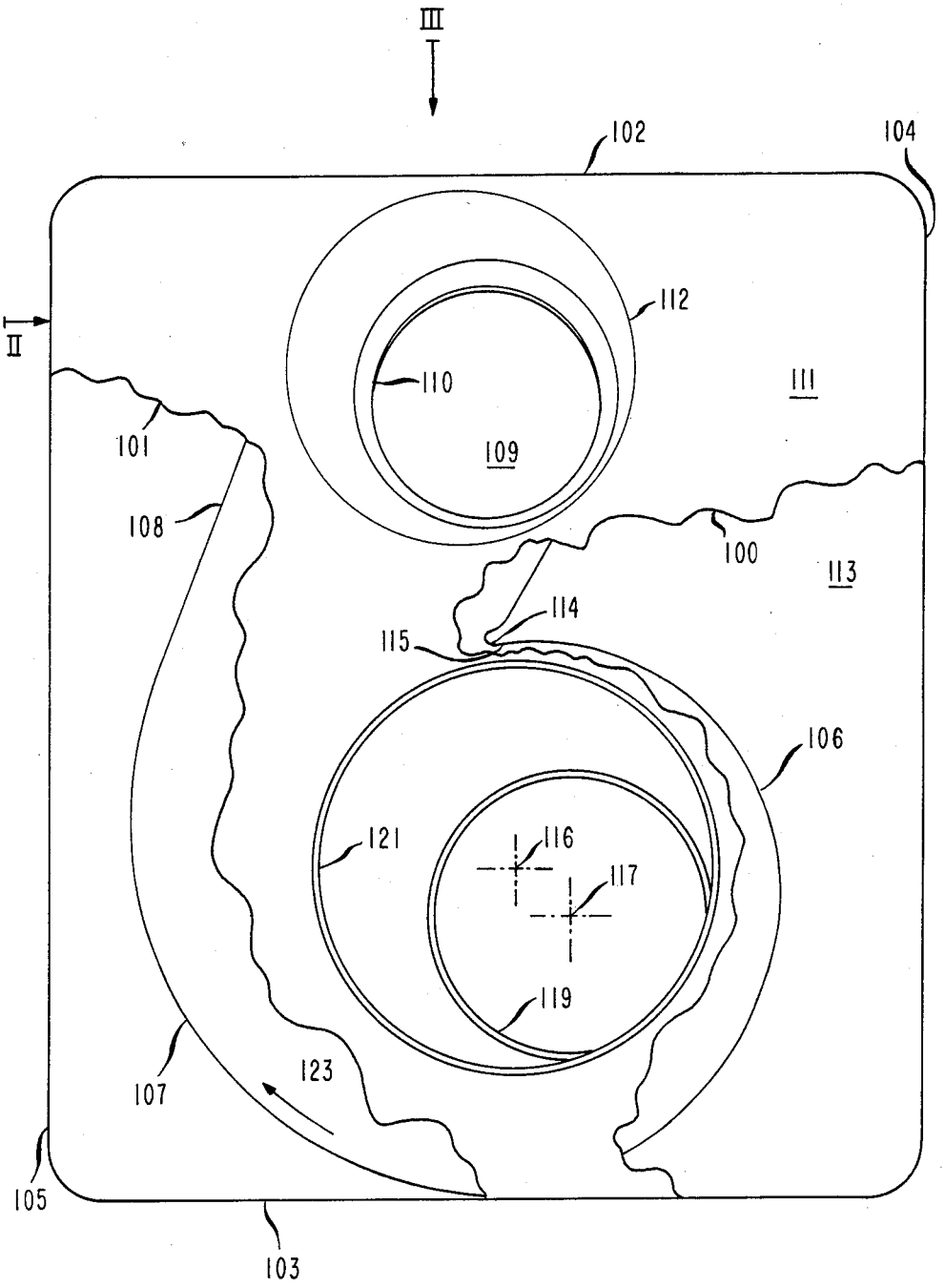
FIG. 1 shows a schematic sectional view of a radial blower according to the invention.

In accordance with the present invention, there is provided a radial blower, which can act as a centrifugal fan or as a radial flow compressor, with a casing which forms a spiral, which is provided with an input port and an output port, where the input port is disposed on the side of the casing and where the middle axis of the input port is displaced relative to the middle axis 10 of the spiral and where the output connects the start of the spiral with the end of the spiral and forms a port 8. The port 8 is increasing in diameter in the outflow direction 16. The increase in diameter can be provided in the plane of the spiral 5. Preferably the increase in diameter is at least about 5 percent and preferably 20 percent per unit, where the units in the outward direction. The units are measured by the diameter of the output port from the edge with the smaller radius spiral end. The ouptut port 8 can be formed like a wedge. The ouptut port can be connected to start 6 of the spiral via a nose 12. The nose 12 can be connected with a diverging wall 14 of the output port 8 via curvature 13. The curvature can be directed concavely and inward to the inner space 17 of the output port 8.

The wedge angle can be between from about 5 and 20 degrees and preferably the wedge angle is about 10 degrees. The wedge can be disposed symmetrically relative to the middle plane 18 of the output 8.

The curvature can be provided with radius from about 5 to 20 millimeters and preferably with a radius of 10 millimeters.

The ratio of the curvatures of the curvature 13 and of the nose 12 can be of about 4 to 1. The center angle of the curvature 13 can reach from about 10 to 50 degrees and preferably the center angle is about 30 degrees.

Figure 5:
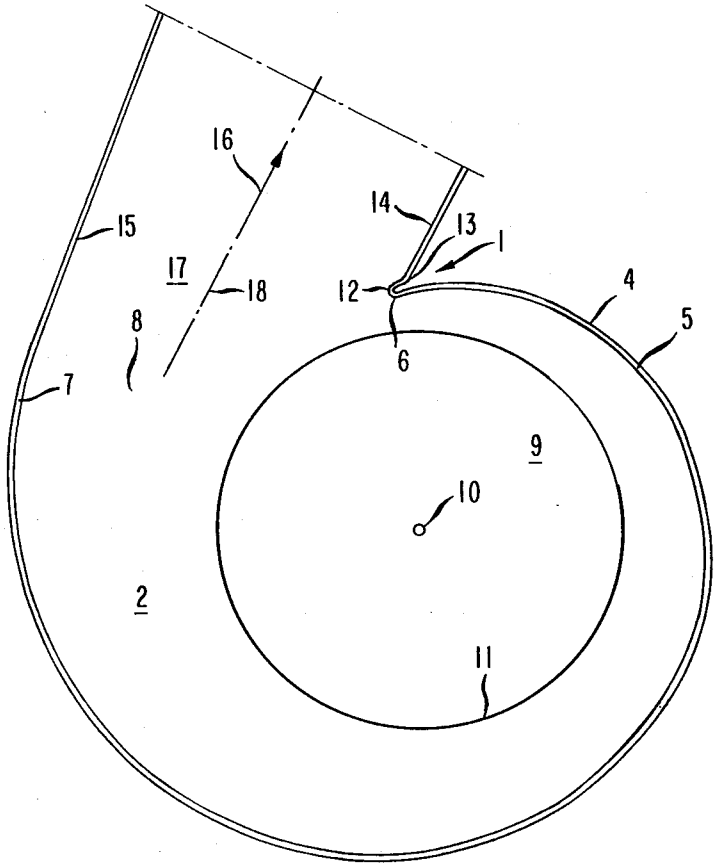
FIG. 5 shows a schematic sectional view of another radial blower according to the present invention.

The drawing shows in FIG. 5 the casing of a radial blower with a removed casing cover. The casing 1 comprises a sheet metal part, which is associated with a base 2 and a removed cover 3, where the base 2 and the cover 3 are connected to each other via a side wall 4. The side wall 4 forms a spiral 5, which reaches from the start 6 to the one end 7, where the spiral increases from the beginning to the end in its outer diameter.

A spiral can have various structures depending on the mathematical equation which determines its shape in cross section. The archimedian spiral is defined by having the radius directly proportional to the covered angle that is, a change in radius is directly proportional to an angle change going from one point of the archimedean spiral to another point. Such an archimedian spiral can approximate many other spirals which have slightly deviating forms. In the context of the present invention, the blower casing can form a part of an archimedian spiral with its outer surface. The smallest diameter of the lower casing starts at an angle of from about 300 to 800 degrees of the archimedian spiral relative to its starting point in the spiral center, and then the spiral runs according to the rule of the archimedian spiral up to an angle of from about 600 to 1150 degrees. The shape does not necessarily have to correspond exactly to the archimedian spiral but can be approximated by it. Preferably deviation of the radia from an archimedian spiral section shape are less than about 5 percent.

The start and the end of the spiral can be connected to each other via an output port 8, which forms a rectangular cross section. A blower wheel 11 is disposed inside of the inner space 9 of the spiral 5. The middle axis of the spiral is designated as 10, and the middle axis of the blower wheel is disposed at the center of the spiral. However, the center axis of the blower wheel does not necessarily have to coincide with the center axis of the spiral.

An input port is provided in the cover of the case 1 not shown here. Preferably the input opening is circular in cross section and its center is disposed at a distance from the middle axis 10.

A nose 12 disposed at the start 6 of the spiral section continues into a side wall 14 of the output port 8 via a curvature 13. Preferably the nose is so shaped that it separates the outgoing stream having sufficient centrifugal speed from the air mass near the fan center without substantial generation of vortex flow. The other opposite wall 15 of the output port 8 immediately adjoins the end of the spiral. The two walls 14 and 15 diverge in the direction of the output 16 such that the narrowest point is disposed at the start of the output port 8. The inner space 17 of the output port 8 thus provides the geometrical figure of a wedge in projection, since only two walls diverge, the bottom and the cover wall, however, do not diverge. The curvature 13 is provided with a radius of about 10 millimeters, which can reach an upper limit of about 20 millimeters and a lower limit of about 5 millimeters. These sizes refer to a nominal blower diameter of about 133 millimeters. In case the nominal blower diameter is changed to a smaller or larger value, then these values of the curvatures also would change proportionally. The curvature 13 is directed such that it is concave relative to the inner space 17 near the output port 16. The curvature expands over a center angle of from about 10 to 50 degrees and is preferably from about 20 to 40 degrees and can be disposed in the middle at about 30 degrees. The radii of curvature of the curved surface and of the nose have a ratio from about 2 to 1 to 10 to 1 and preferably from about 3 to 1 to 5 to 1 such as, for example, 4 to 1, which means that the curvature of the nose is rounded to about 2.5 millimeters, which is directed into the inner space 17 or, respectively, 9.

The FIG. 1 shows a side view of the blower, where the cover of the blower, which is positioned vertically, is broken up along two fracture lines 100 or, respectively, 101. Correspondingly the casing is provided with an upper side 102 and a lower side 103. If the blower is mounted to the corresponding gas burner, then the lower side 103 is positioned at a distance and parallel to the bottom side. Correspondingly side walls 104 and 105 result. The front side, which is the figure plane, and the back side of the case are connected to each other with walls 106 or, respectively, 107 of a spiral. The output exit of the spiral is designated as an exit port 108. The exit port 108 runs, after a deflection of 90 degrees, to the exit opening 109. The corresponding circular boundary is designated as 110. Since this exit opening 110 is disposed inclined, which can be seen in FIG. 2, this results, in addition, to lines disposed next to each other in the upper region of the figure. An opening 112 is present on the rear side 111, which is not material for the blower and which serves other purposes. The opening 109 is present on the front wall 113, which is disposed opposite to the rear wall.

The nose 114 can be recognized easily in FIG. 1. This nose narrows on the one hand the cross section of the exit port 108 and, on the other hand, connects this exit port to the starting point of the spiral section 115. The center points 116 and 117 can be recognized in FIG. 1, where the center point 116 is the center of the opening which receives the motor, is also disposed concentrically to the motor axis and further, is disposed concentrically to the blower wheel 118. The second recited center point 117 defines the center of the input opening 119. The motor is designated with 120. The motor flange opening is designated as 121. The view of FIG. 2 results if one looks on the subject of FIG. 1 in the direction of the corresponding arrow II.

Figure 2:
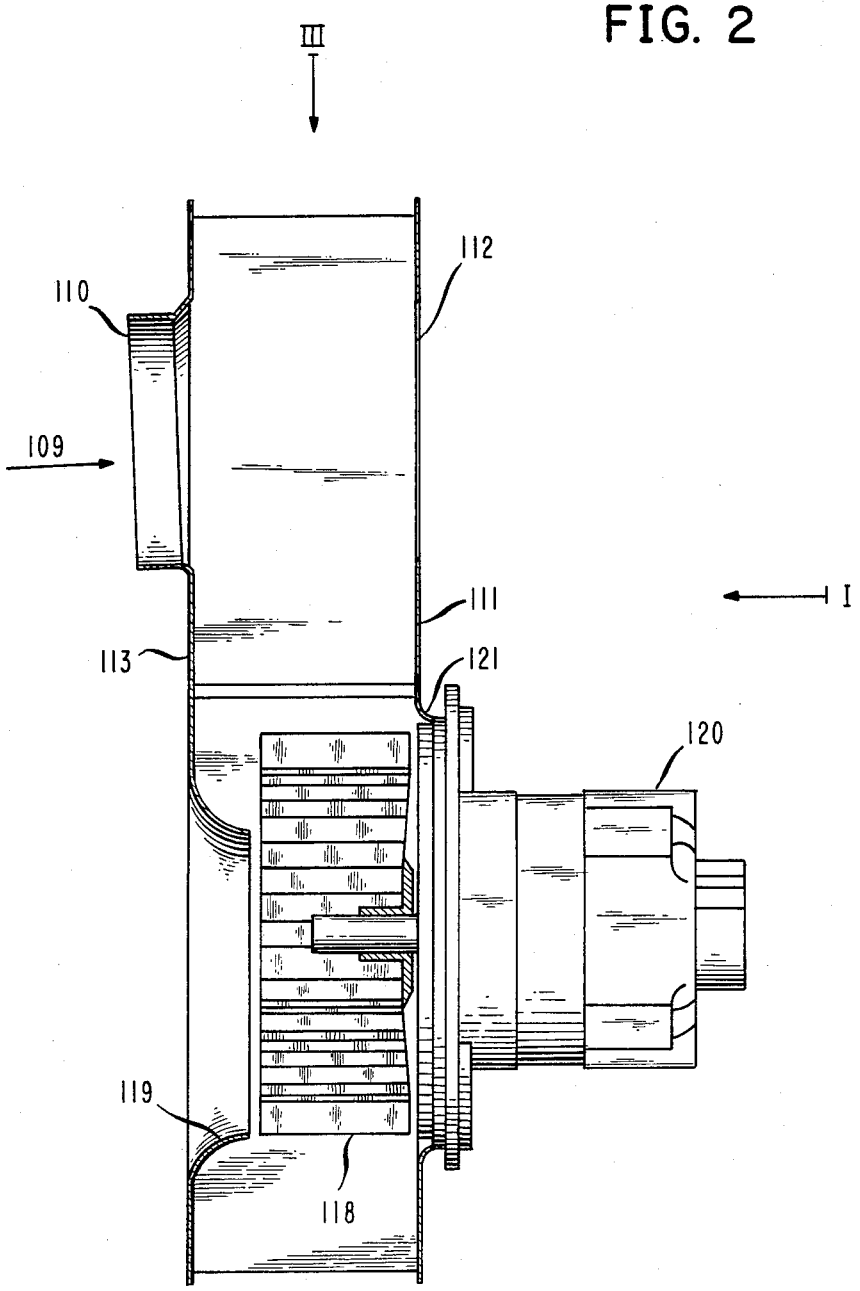
FIG. 2 shows a schematic elevational side view of the radial blower of FIG. 1.
Figure 3:
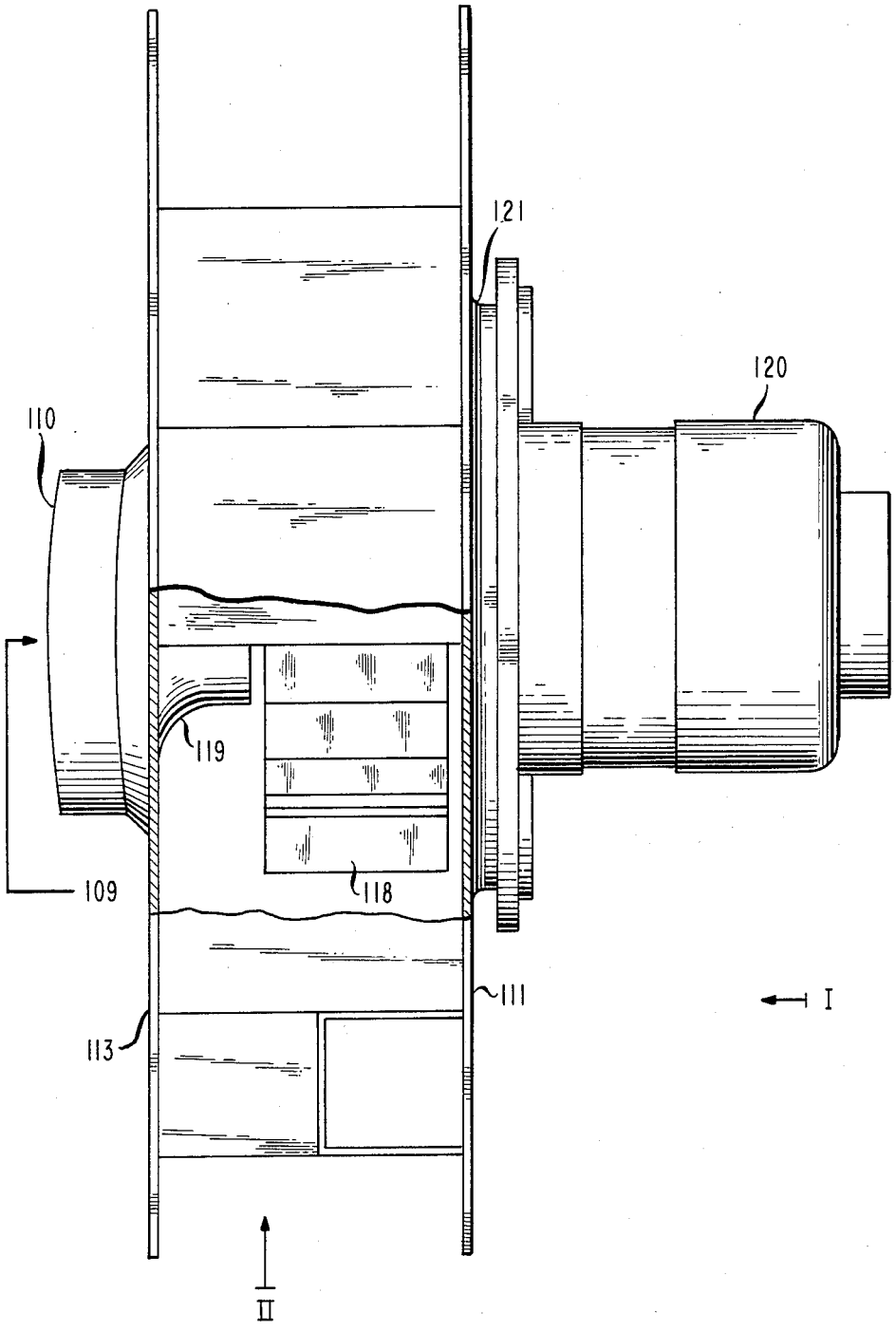
FIG. 3 shows a schematic top plan view of the radial blower of FIG. 1.

FIG. 2 results, if one views onto FIG. 1 in the direction of the corresponding arrow. A further side view of the blower is shown in FIG. 3, which results if one looks onto FIG. 1 in the direction of the arrow FIG. III. The blower wheel 118 is a standard commercial paddle blade blower wheel. If the motor 120 is turned around, it sucks air into its center area via the opening 119. The air passes over the radial circumference by the paddle blades and thus enters into the annular spiral space between the inner wall of the part 106 and the outer wall of the part 108. An air exit in the same rotational direction results by the exit in rotational direction according to arrow 123. The nose 114 effects a quasi tangential removal of this air transport stream which has been in a circular motion in the direction of the channel of the exit port 108. The nose prevents co-running of the air by more than one rotation and decreases the pressure loss in the blower by avoiding push pulses.

Figure 4:
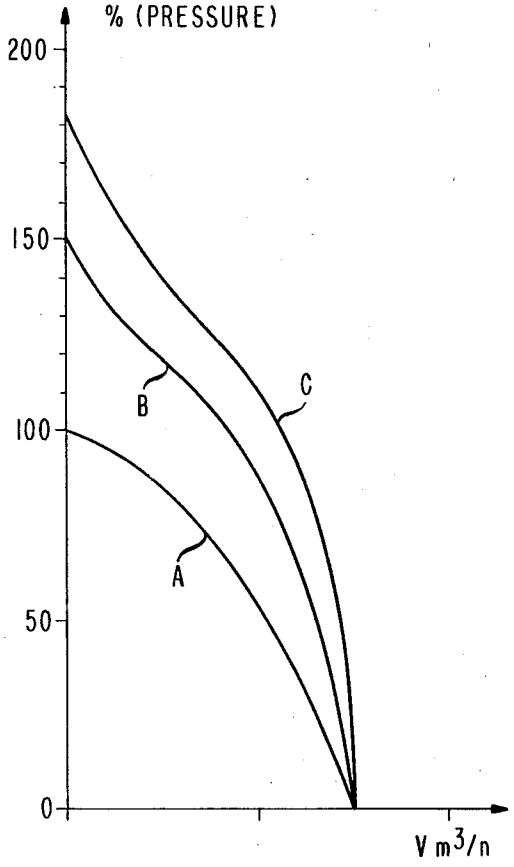
FIG. 4 is a schematic plot for illustrating advantages of the present invention.

The technical advance achievable according to the present invention can be recognized in FIG. 4, where a diagram comprising three curves a, b and c is illustrated. a indicates the state of the art according to a commercial blower of the same kind of construction however without nose 114. One recognizes that the abscissa represents the transported volume and that the ordinate represents the pressure. It is recognized that in the case of small amounts passing through and correspondingly high pressures, the corresponding transported volume varies considerably under slight pressure variations. For this reason, a blower according to b and c is a substantial improvement. The blower b is generated if the nose 114 is formed as a regular tip, without decreasing the cross section of the port 108. It can be recognized that then the characteristic curve becomes substantially steeper, that is, smaller pressure changes are coordinated to substantially smaller flow volume changes. The characteristic curve according to c is generated based on the invention construction, based on the narrowing of the free passage cross-section of the output blow port through the nose together with an expansion of the port in exit direction.

It can be recognized from the drawing that the two sides 14 and 15 of the output port, which are diverging relative to each other, are disposed in the plane of the spiral. The one side 14 of the blower port 18 is connected by the nose 12 to the start 6 of the spiral 4. The curvature in this is here disposed between the port wall 14 and the nose 12.

The angle of the wedge, under which the two side 14 and 15 of the output port 8 diverge can be from about 5 to 20 degrees and is preferably selected at about 10 degrees. The diverging sides are disposed symmetric to the center plane 18 of the output port 8. The casing 1 of the blower is preferably formed from sheet metal. It is particularly advantageous if this radial blower is constructively joined with a burner to a blower burner, since this blower is characterized by a particularly advantageous curve.

Figure 6:
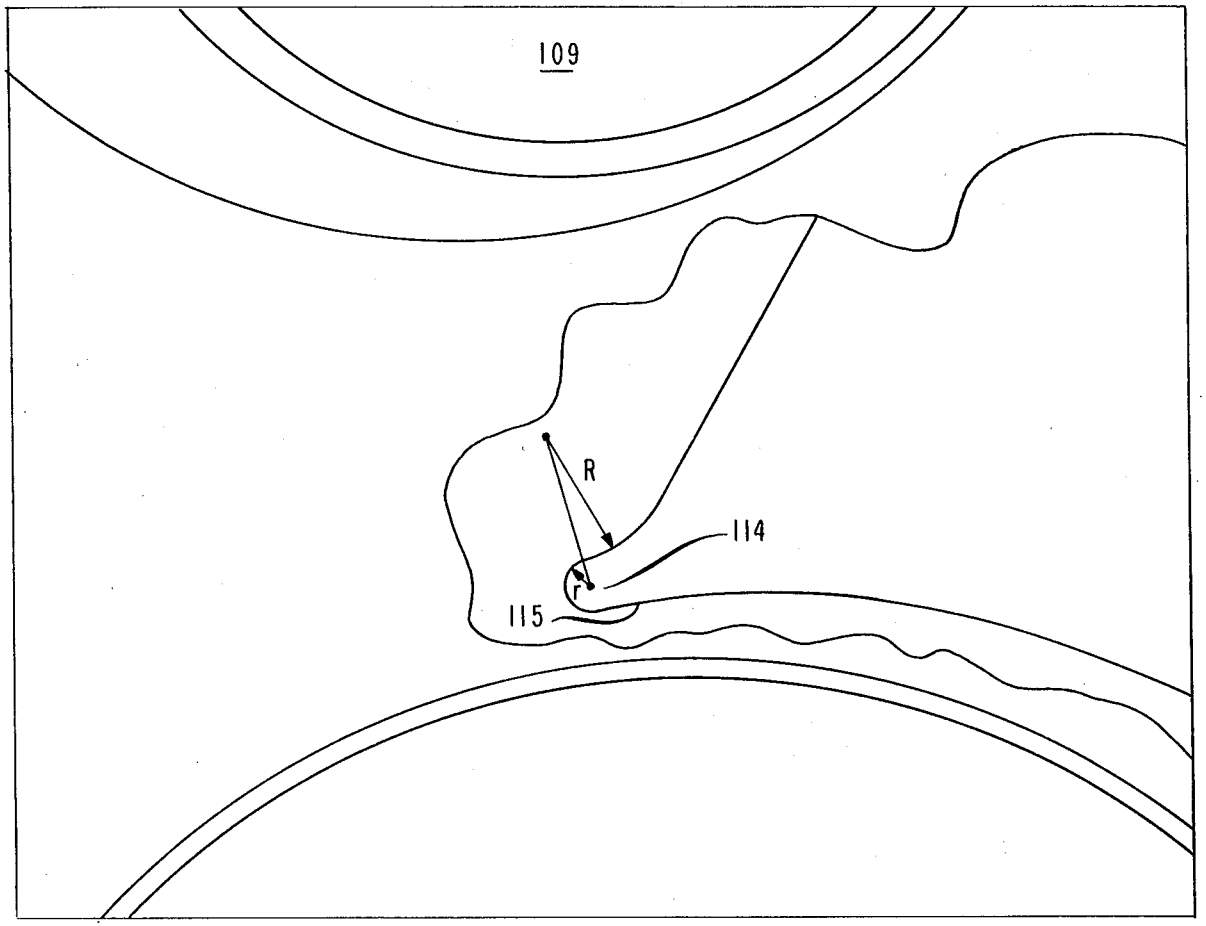
FIG. 6 shows an enlarged detail view of the nose of the embodiment of FIG. 1.

The overall angle between the tangent of the smaller radius spiral section and the output port 8 wall 14 near the nose 12 can be from about 30 to 80 degrees and is preferably from about 50 to 60 degrees. An enlarged detail view of the curved surface and of the nose of the embodiment of FIG. 1 is illustrated in FIG. 6. In addition, a radius of curvature r for the nose and a radius of curvature for the curved surface R is illustrated in FIG. 6. It can be recognized that the curvatures r and R are directed oppositely relative to the concerned area of the wall of the blower and that the curved surface is formed convex relative to the inside of the blower and that the nose is formed concave versus the inside of the blower.

It will be understood that each of the elements described above, or two or more together, may also find a useful application in other types of system configurations and procedures differing from the types described above.

While the invention has been illustrated and described as embodied in the context of a radial blower it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A radial blower with a case forming a spiral having a spiral axis which comprises an input port having a center in the opening plane of the spiral;

an output port with a diameter which increases toward an outside flow discharge end symmetrically relative to a middle plane; and a casing to which is attached the input port and the output port, where the input port is disposed in an axial direction of the spiral axis, and where the entrance of the input port is displaced relative to the spiral axis and where the output port is formed like a wedge, and where one side of the wedge joins a side of an inner spiral end at an acute angle such that the connection point of the smaller diameter side of the spiral and of the corresponding wall of the output port join into a joint edge, where the edge is formed by a nose and a curved surface, wherein the curved surface adjoins said wall of the output port and is formed substantially as a curved section with a radius of curvature R directed inwardly into the blower and providing a concave surface to the inside of the blower, wherein the nose adjoins said wall of the spiral and is formed substantially as a curved section with a radius of curvature r directed outwardly outside of the blower and providing a convex surface to the inside of the blower, and wherein the absolute value of the ratio of the radii of the curved surface R and of the curvature of the nose r is from about 2:1 to 10:1 for relatively enhancing the pushing power of the rotary fan and for relatively decreasing the flow resistance of the output port to the medium being discharged.

2. The radial blower with a case forming a spiral according to claim 1 wherein the spiral over a section can be approximated by an archimedian spiral where the radius is a multiple of the angle passed over relative to the center of the spiral and where the connection point of the inner spiral to the output port corresponds to an angle of from about 200 to 800 degrees and where the connection point of the outer spiral to the output port corresponds to an angle of from about 500 to 1150 degrees.

3. The radial blower with a case forming a spiral according to claim 2 wherein the conenction point of the inner spiral to the output port corresponds to an angle of from about 300 to 500 degrees and where the connection point of the outer spiral to the output port corresponds to an angle of from about 600 to 850 degrees.

4. The radial blower with a case forming a spiral according to claim 1 wherein the wedge angle of the output port is between from about 5 to 20 degrees.

5. The radial blower with a case forming a spiral according to claim 1 wherein the wedge opening angle of the output port is from about 8 to 12 degrees.

6. The radial blower with a case forming a spiral according to claim 1 wherein the output port is attached to the start of the spiral via a nose.

7. The radial blower with a case forming a spiral according to claim 6 wherein the curved surface is directed concavely to the inner space of the output port.

8. The radial blower with a case forming a spiral according to claim 1 wherein the curvature of the curved surface has a radius of from about 5 to 20 millimeters.

9. The radial blower with a case forming a spiral according to claim 8 wherein the curvature of the curved surface has a radius of from about 8 to 12 millimeters.

10. The radial blower with a case forming a spiral according to claim 8 wherein the center angle of the curvature is from about 10 to 50 degrees.

11. The radial blower with a case forming a spiral according to claim 10 herein wherein the center angle of the curvature is from about 25 to 35 degrees.

12. A radial blower with a case forming a spiral having a spiral axis which comprises an input port having a center in the opening plane of the spiral;

an output port with a diameter which increases toward an outside flow discharge end symmetrically relative to a middle plane; and a casing to which is attached the input port and the output port, where the input port is disposed in an axial direction of the spiral axis, and where the axis of the entrance of the input port is displaced relative to the spiral axis, and where the output port is formed like a wedge, where the wedge joins the larger diameter side of the spiral at an obtuse angle and where the wedge joins the smaller diameter end of the spiral in a juncture edge at an acute angle, wherein the juncture edge is formed by a curved surface and by a protruding nose such that one side of the curved surface adjoins the wedge section and that one side of the nose adjoins the spiral end such that a second side of the curved surface adjoins a second side of the nose; where the nose is associated with a radius of curvature r pointing to the outside of the blower, and where the curved surface is associated with a radius R of curvature pointing to the inside of the blower such that, as seen from the inside of the blower, the curved surface forms a concave section and the nose forms a convex section; and wherein the absolute value of the ratio of the radii of curvature of the curved surface and of the curvature of the nose is from about 2:1 to 10:1 for relatively enhancing the pushing power of the rotary fan and for relatively decreasing the flow resistance of the output port to the medium being discharged.

13. A radial blower with a case forming a spiral having a spiral axis which comprises an input port;

an output port with a diameter which increases toward an outside flow discharge end symmetrically relative to a middle plane; and a spiral casing to which is attached the input port and the output port, where the input port is disposed in an axial direction of the spiral axis and adjoins the spiral at a location displaced away from the output port and where the output port is formed like a wedge, and where one side of the wedge joins a side of an inner spiral end at an acute angle such that the connection point of the smaller diameter side of the spiral and of the corresponding wall of the output port form a joint edge, which edge is formed by a nose and a curved surface, wherein the curved surface adjoins said wall of the output port and is formed substantially as a curved section with a radius of curvature R directed inwardly into the outut port and providing a concave surface to the inside of the output port, wherein the nose adjoins said wall of the spiral and is formed substantially as a curved section with a radius of curvature r directed outwardly outside of the blower and providing a convex surface to the inside of the blower, and wherein the absolute value of the ratio of the radii of the curved surface R and of the curvature of the nose r is from about 2:1 to 10:1 for relatively enhancing the pushing power of the rotary fan and for relatively decreasing the flow resistance of the output port to the medium being discharged.

14. The radial blower with a case forming a spiral according to claim 13 wherein the spiral over a section can be approximated by an archimediam spiral where the radius is a multiple of the angle pased over relative to the center of the spiral and where the connection point of the inner spiral to the output port corresponds to an angle of from about 200 to 800 degrees and where the connection point of the outer spiral to the output port corresponds to an angle of from about 500 to 1150 degrees.

15. The radial blower with a case forming a spiral according to claim 14 wherein the connection point of the inner spiral to the output port corresponds to an angle of from about 300 to 500 degrees and where the connection point of the outer spiral to the output port corresponds to an angle of from about 600 to 850 degrees.

16. The radial blower with a case forming a spiral according to claim 13 wherein the wedge opening angle of the output port is between from about 5 to 20 degrees.

17. The radial blower with a case forming a spiral according to claim 13 wherein the wedge opening angle of the output port is from about 8 to 12 degrees.

18. The radial blower with a case forming a spiral according to claim 13 wherein the output port is attached to the start of the spiral via a nose.

19. The radial blower with a case forming a spiral according to claim 13 wherein the curvature of the curved surface has a radius of from about 5 to 20 millimeters.

* * * * *